US007909433B2

(12) United States Patent
Yoshida et al.

(10) Patent No.: US 7,909,433 B2
(45) Date of Patent: Mar. 22, 2011

(54) LIQUID EJECTING APPARATUS AND RASTER LINE FORMING METHOD

(75) Inventors: Masahiko Yoshida, Shiojiri (JP); Takeshi Yoshida, Shiojiri (JP); Michiaki Tokunaga, Matsumoto (JP); Tatsuya Nakano, Hata-machi (JP)

(73) Assignee: Seiko Epson Corporation, Tokyo (JP)

( * ) Notice: Subject to any disclaimer, the term of this patent is extended or adjusted under 35 U.S.C. 154(b) by 362 days.

(21) Appl. No.: 12/284,224

(22) Filed: Sep. 18, 2008

(65) Prior Publication Data

US 2009/0085959 A1 Apr. 2, 2009

(30) Foreign Application Priority Data

Sep. 18, 2007 (JP) ..... 2007-241370
Jul. 16, 2008 (JP) ..... 2008-185235

(51) Int. Cl.
*B41J 2/21* (2006.01)

(52) U.S. Cl. ..... 347/41

(58) Field of Classification Search ..... 347/12, 347/40, 15, 43, 41
See application file for complete search history.

(56) References Cited

U.S. PATENT DOCUMENTS 5,594,478 A * 1/1997 Matsubara et al. ..... 347/41
5,686,944 A * 11/1997 Takagi et al. ..... 347/41
6,299,283 B1 * 10/2001 Kakutani et al. ..... 347/41
2007/0035569 A1 2/2007 Koto et al.

FOREIGN PATENT DOCUMENTS

JP 2004255335 A 9/2004
WO WO-01/03930 A1 1/2001

* cited by examiner

*Primary Examiner* — Lamson D Nguyen
(74) *Attorney, Agent, or Firm* — Nutter McClennen & Fish LLP; John J. Penny, Jr.

(57) ABSTRACT

A liquid ejecting apparatus including a head unit that has a plurality of heads along a first direction, in which a plurality of nozzles that eject a liquid onto a medium are lined up in the first direction, and that ejects the liquid while moving relative to the medium in a second direction, which intersects the first direction, the head unit having a width in the first direction that is greater than a width of a medium in the first direction, a movement mechanism that makes the head unit move relative to the medium a plurality of times alternately in the second direction and the first direction, and a control section that forms a raster line group by forming each raster line.

4 Claims, 12 Drawing Sheets

LIQUID EJECTING APPARATUS AND RASTER LINE FORMING METHOD

CROSS-REFERENCE TO RELATED APPLICATIONS

The present application claims priority from Japanese Patent Application No. 2007-241370 filed on Sep. 18, 2007, and Japanese Patent Application No. 2008-185235 filed on Jul. 16, 2008, which are herein incorporated by reference.

BACKGROUND

1. Technical Field

The present invention relates to liquid ejecting apparatuses and raster line forming methods.

2. Related Art

Inkjet printers that carry out printing by ejecting a liquid (ink) onto various media such as paper, cloth, and film are well known as an example of liquid ejecting apparatuses. These printers are provided with a head in which a plurality of nozzles for ejecting liquid onto a medium are arranged in a first direction (sub-scanning direction), and this head ejects liquid while moving in a second direction (main scanning direction) that intersects the first direction (International Publication WO 01/03930).

From a viewpoint of increasing picture quality, the above-mentioned printer carries out so-called overlap printing, for example. That is, the printer alternately moves the head a plurality of times in the second direction and the first direction, and forms a single raster line by causing two or more different nozzles to eject liquid.

Incidentally, from a viewpoint of increasing the printing speed, some printers are provided with a head unit that has a plurality of the aforementioned heads arranged along the first direction. In this case it is conceivable that the width in the first direction of the head unit is made wider than the width in the first direction of the medium such that liquid is ejected at one time across an entire width of the medium, for example. However, with this configuration, in the case where a total amount of movement of the head unit in the first direction during printing is large, it is necessary to increase the width of the head unit in the first direction in order to have liquid ejected across the entire width of the medium at a single time during movement in the second direction.

Further, it is known that liquid ejecting characteristics vary due to individual differences of the heads. For example, one head has a characteristic of ejecting liquid easily, while another head has a characteristic of ejecting liquid with difficulty. For this reason, in the case where the plurality of heads that constitute the head unit ejects liquid, a so-called density irregularity or the like may occur due to differences in the ejection characteristics of each of the heads and as a result, there is a risk for image quality to deteriorate.

SUMMARY

The present invention has been devised in light of these issues, and it is an advantage thereof to control an increase in the width in the first direction of the head unit as well as to curb deterioration in image quality.

A primary aspect of the invention is directed to a liquid ejecting apparatus such as the following.

A liquid ejecting apparatus including a head unit that has a plurality of heads along a first direction, in which a plurality of nozzles that eject a liquid onto a medium are lined up in the first direction, and that ejects the liquid while moving relative to the medium in a second direction, which intersects the first direction, the head unit having a width in the first direction that is greater than a width of the medium in the first direction, a movement mechanism that makes the head unit move relative to the medium a plurality of times alternately in the second direction and the first direction, and a control section that forms a raster line group by forming each raster line by making two or more different nozzles that are different eject the liquid, respectively while making the movement mechanism move the head unit relative to the medium a plurality of times alternately in the second direction and the first direction, makes the movement mechanism move the head unit relatively so that a total amount of movement of the head unit in the first direction when the head unit has moved relatively the plurality of times is less than an effective nozzle width of one of the heads in the first direction, and forms the raster line group so that a number of the raster lines formed by making the nozzles of only one of the heads eject the liquid is not greater than a number of the raster lines formed by making the nozzles of two or more of the heads eject the liquid.

Other features of the invention will be made clear by reading the description of the present specification with reference to the accompanying drawings.

DESCRIPTION OF EXEMPLARY EMBODIMENTS

Figure 1:
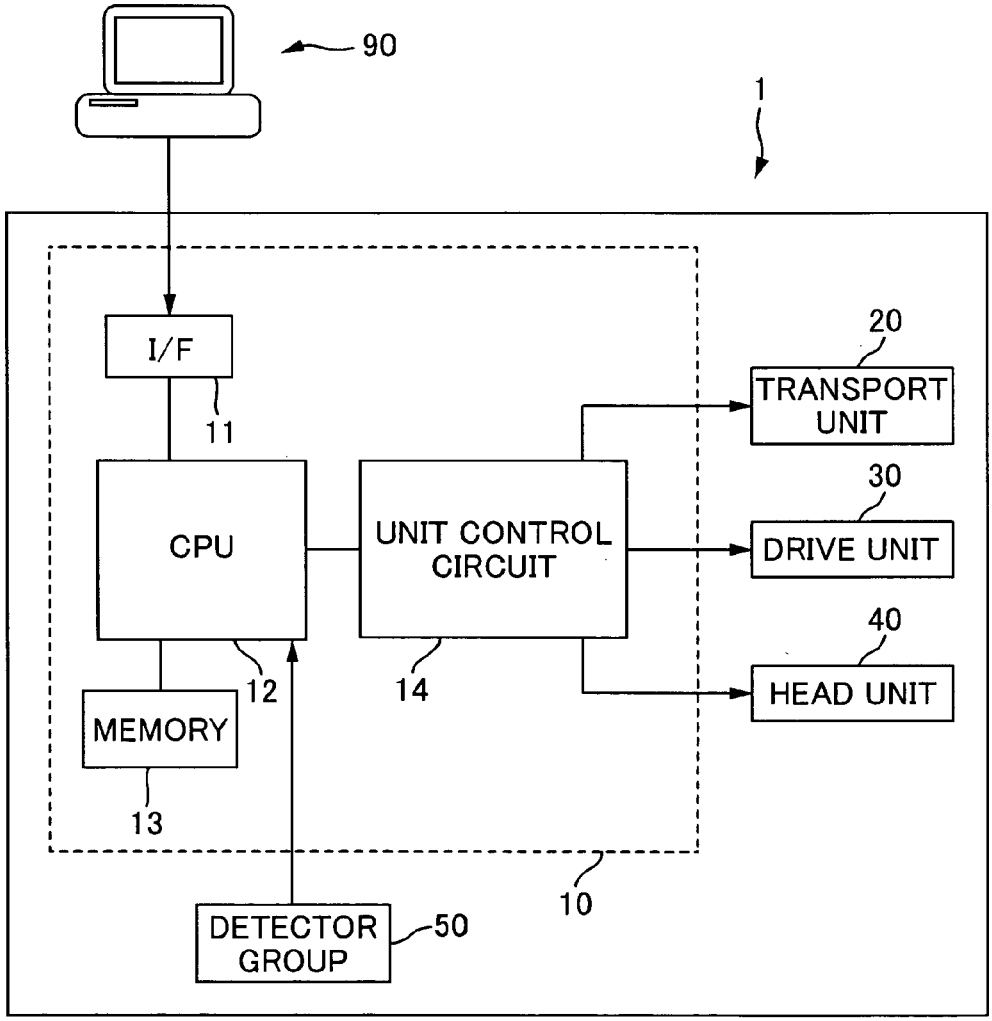
FIG. 1 is a block diagram showing an overall configuration of a printer 1.

At least the following matters will be made clear by the present specification and the accompanying drawings.

A liquid ejecting apparatus including:

a head unit that has a plurality of heads along a first direction, in which a plurality of nozzles that eject a liquid onto a medium are lined up in the first direction, and that ejects the liquid while moving relative to the medium in a second direction, which intersects the first direction, the head unit having a width in the first direction that is greater than a width of the medium in the first direction, a movement mechanism that makes the head unit move relative to the medium a plurality of times alternately in the second direction and the first direction, and a control section that forms a raster line group by forming each raster line by making two or more different nozzles that are different eject the liquid, respectively while making the movement mechanism move the head unit relative to the medium a plurality of times alternately in the second direction and the first direction, makes the movement mechanism move the head unit relatively so that a total amount of movement of the head unit in the first direction when the head unit has moved relatively the plurality of times is less than an effective nozzle width of one of the heads in the first direction, and forms the raster line group so that a number of the raster lines formed by making the nozzles of only one of the heads eject the liquid is not greater than a number of the raster lines formed by making the nozzles of two or more of the heads eject the liquid.

According to such a liquid ejecting apparatus, width in a first direction of the head unit can be controlled from increasing and the deterioration in image quality can be controlled as well.

Further, in the liquid ejecting apparatus, it is preferable that in a case where a number of movements by the head unit in the second direction when the head unit moves relatively the plurality of times is set to an m number of times, all the heads eject the liquid during each movement in the second direction.

In this case, the raster line groups can be formed while reducing the total amount of movement of the head unit with a minimum number of heads.

Furthermore, in the liquid ejecting apparatus, it is preferable that:

in a case where a number of movements by the head unit in the first direction when the head unit moves relatively the plurality of times is set to an n number of times, each amount of movement in the first direction is a same.

In this case, deterioration in image quality can be effectively curbed.

Furthermore, a raster line forming method includes:

preparing a head unit that has a plurality of heads along a first direction, in which a plurality of nozzles that eject a liquid onto a medium are lined up in the first direction, and that ejects the liquid while moving relative to the medium in a second direction, which intersects the first direction, a width of the head unit in the first direction being greater than a width of the medium in the first direction, and forming a raster line group by forming each raster line by making two or more of the nozzles that are different eject the liquid, respectively while making the head unit move relatively with respect to the medium a plurality of times alternately in the second direction and the first direction, the head unit made to move relatively so that a total amount of movement of the head unit in the first direction when the head unit has moved relatively the plurality of times is less than an effective nozzle width of one of the heads in the first direction, and the raster line group formed so that a number of the raster lines formed by making the nozzles of only one of the heads eject the liquid is not greater than a number of the raster lines formed by making the nozzles of two or more of the heads eject the liquid.

With such a raster line forming method, width in a first direction of the head unit can be controlled from increasing and the deterioration in image quality can be curbed as well.

Configuration Example of an Inkjet Printer

An inkjet printer (hereinafter referred to as "printer 1"), which is one example of a liquid ejecting apparatus, is for printing by an inkjet system onto a band-shaped printing tape T, which is one example of a medium, unit images that are later cut out for use such as printing items that are affixed on wrapping film for fresh foods, for example. Here, the printing tape T is a rolled paper (continuous paper) with a release paper, and images for printed items are printed continuously in a direction in which the printing tape T is continuous.

Configuration of Printer 1

Figure 2A:
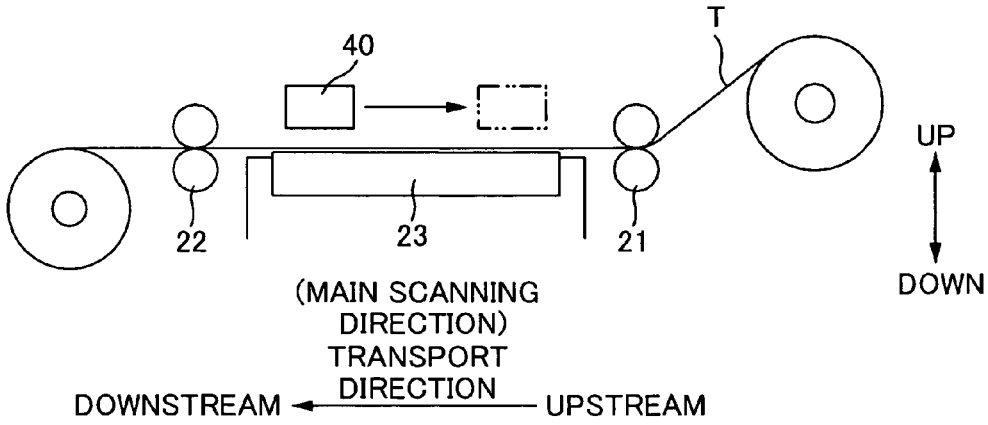
FIG. 2A is a schematic cross-sectional view of the printer 1.
Figure 2B:
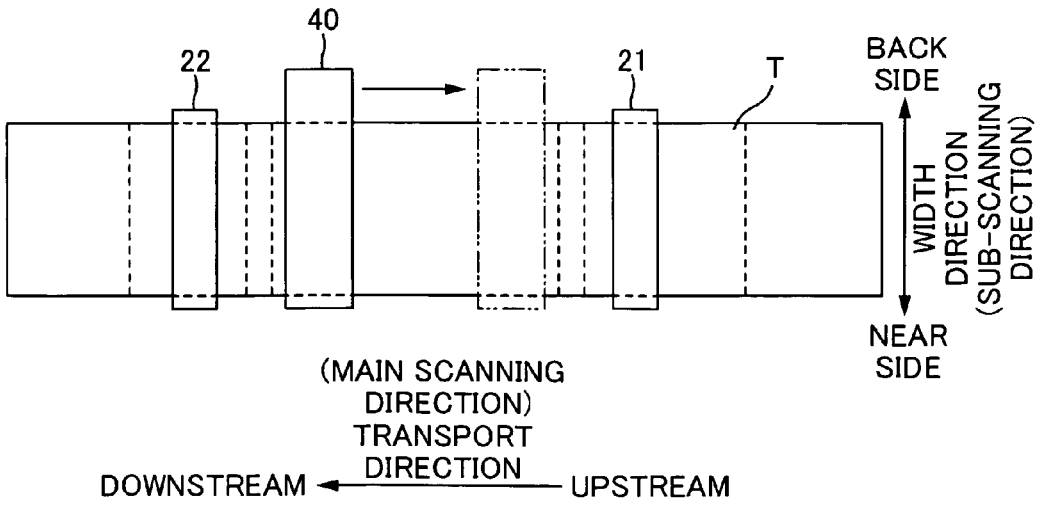
FIG. 2B is a schematic top view of the printer 1.
Figure 3:
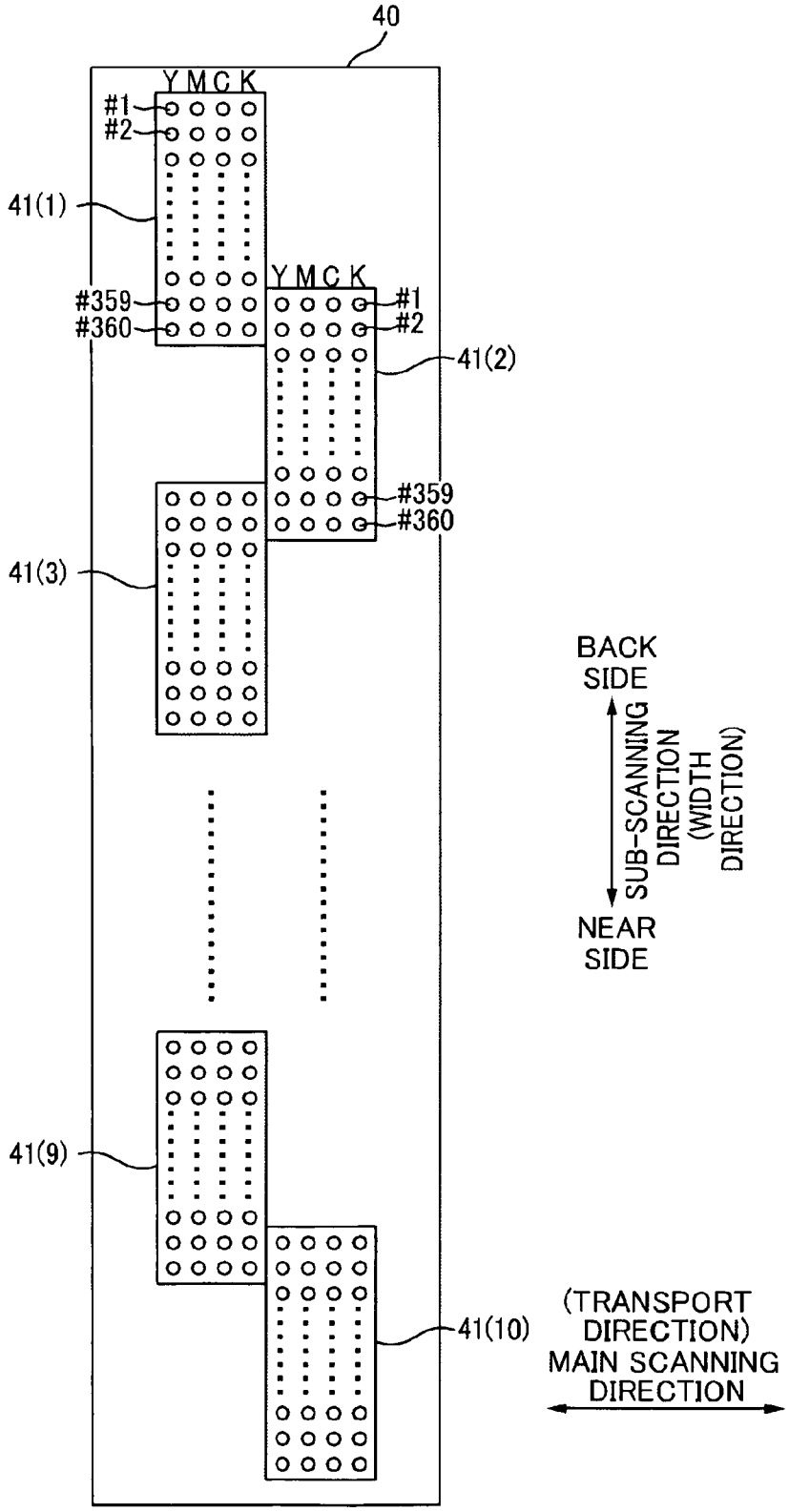
FIG. 3 is a diagram for describing a nozzle arrangement on a lower face of a head unit 40.

FIG. 1 is a block diagram showing an overall configuration of the printer 1. FIG. 2A is a schematic cross-sectional view of the printer 1, and FIG. 2B is a schematic top view of the printer 1. FIG. 3 shows a nozzle arrangement on a lower face of a head unit 40.

Upon receiving print data, the printer 1 controls each unit (a transport unit 20, a drive unit 30, and the head unit 40) with a controller 10, which is one example of a control section, and forms an image on the printing tape T. It should be noted that conditions within the printer 1 are monitored by a detector group 50, and the controller 10 controls each unit based on detection results thereof.

The transport unit 20 is for transporting the printing tape T in a direction in which the printing tape T is continuous (hereinafter referred to as transport direction) from an upstream side to a downstream side. The transport unit 20 is provided with components such as feed rollers 21, feed out rollers 22, and a suction table 23. The feed rollers 21 feed the printing tape T, which is in a roll form before printing, onto the suction table 23, which is a printing region. The suction table 23 holds the printing tape T by performing vacuum suction on the printing tape T from below. The feed out rollers 22 feed out the printed printing tape T from the printing region. The printing tape T that has been fed out from the printing region is wound into a roll form by a winding mechanism.

The drive unit 30 is a movement mechanism that causes the head unit 40 to move freely in the main scanning direction, which corresponds to the transport direction, and the sub-scanning direction, which corresponds to the width direction of the printing tape T. The drive unit 30 is constituted for example by an X movement table, which causes the head unit 40 to move in the main scanning direction, and a Y movement table, which causes the X movement table holding the head unit 40 to move in the sub-scanning direction, and a motor that causes these tables to move (not shown).

The head unit 40 forms dot rows (raster lines) on the printing tape T by ejecting ink while moving in the main scanning direction. A collection of these dot rows forms an image and therefore an image is printed by forming these dot rows. The head unit 40 has ten heads 41 and the ten heads 41 are arranged in a staggered manner in the width direction (sub-scanning direction). And the ten heads are arranged so that ink can be ejected across the entire width of the printing tape T by a single movement of the head unit 40 in the main scanning direction, that is, arranged so that the width of the head unit 40 in the sub-scanning direction is wider than the width of the printing tape T.

Furthermore, a nozzle row Y that ejects yellow ink, a nozzle row M that ejects magenta ink, a nozzle row C that ejects cyan ink, and a nozzle row K that ejects black ink are formed on the lower face of each of the heads 41. In each nozzle row, 360 uniformly spaced (360 dpi) nozzles are lined up in the width direction. Furthermore, of the two heads adjacent in the width direction (here description is given using head 41(1) and head 41(2) as an example), nozzles #359 and #360 at the nearest side of the back side head 41(1) and nozzles #1 and #2 at the farthest side of the near side head 41(2) are arranged on same lines (that is, the nozzles overlap). It should be noted that in the present embodiment, the sub-scanning direction corresponds to the first direction and the main scanning direction corresponds to the second direction.

Movement of the Head Unit 40 During Printing

FIG. 4A to FIG. 4I are schematic diagrams for describing how the head unit 40 moves during printing. The printer 1 forms dot rows (raster lines) with the head unit 40 by moving four times in the main scanning direction. It should be noted that during printing, the printing tape T is in a state of being held on the suction table 23 without being transported.

Figure 4A:
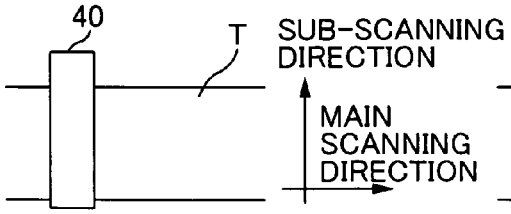
FIG. 4A to FIG. 4I are schematic diagrams for showing how the head unit 40 moves during printing.
Figure 4B:
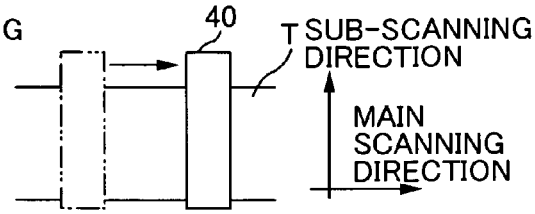
Figure 4C:
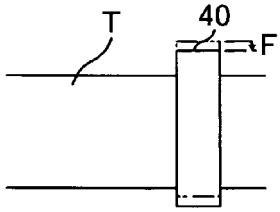
Figure 4D:
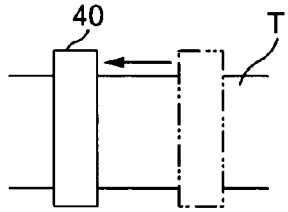
Figure 4E:
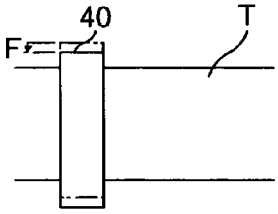
Figure 4F:
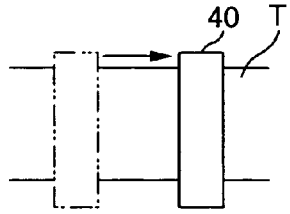
Figure 4G:
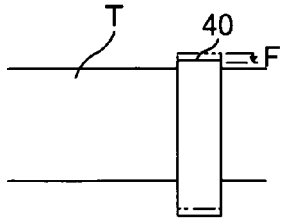
Figure 4H:
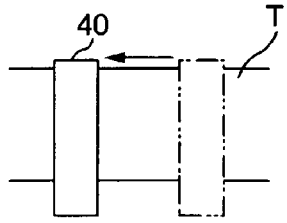
Figure 4I:
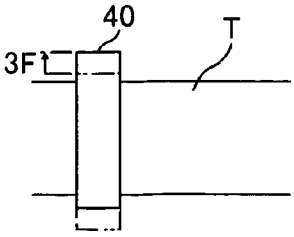

Before printing, the head unit 40 is at a standby at a home position (a position shown in FIG. 4A). During printing, first the head unit 40 is moved by the drive unit 30 in the main scanning direction from the downstream side to the upstream side (FIG. 4B). Then, during this movement (pass 1), ink is ejected from the nozzles of the head unit 40 across the entire width of the printing tape T such that dot rows of pass 1 are formed on the printing tape T. Having been moved in the main scanning direction, the head unit 40 is then moved by the drive unit 30 in the sub-scanning direction from the back side to the near side (FIG. 4C), thereafter, the head unit 40 is moved in the main scanning direction (pass 2) from the upstream side to the downstream side (FIG. 4D) while ink is ejected from the nozzles across the entire width of the printing tape T to form dot rows of pass 2. Here the term "pass" refers to a single movement of the head unit 40 along the main scanning direction, and the number attached to the term "pass" indicates the order in which the pass is carried out.

In this manner, the head unit 40 moves alternately with movements of the head unit 40 in the main scanning direction (FIG. 4B, FIG. 4D, FIG. 4F, and FIG. 4H) and movements of the head unit 40 in the sub-scanning direction (FIG. 4C, FIG. 4E, and FIG. 4G) to form dots. In this way, a plurality of dot rows (raster line groups) are formed across the entire width of the printing tape T. Then, after completing the movement in the main scanning direction for the fourth time (pass 4 in FIG. 4H), the head unit 40 moves in the sub-scanning direction to the back side (FIG. 4I) and is positioned in the home position shown in FIG. 4A. In this way, a series of movements of the head unit 40 during printing is completed.

Density Irregularities Arising from Ejection Characteristic Differences Among the Heads 41

It is known that ink ejection characteristics vary due to individual differences of the heads 41. For example, in contrast to the nozzles of a particular head 41 from which ink is ejected easily, ink may be ejected with difficulty from the nozzles of a different head 41. Thus, in the case where printing is performed using the head unit 40, which has ten heads 41 having individual differences, so-called density irregularities may occur arising from differences of ejection characteristics among the heads 41.

Here, of the ten heads 41, description is given using head 41(3), head 41(4), and head 41(5) as examples. Suppose that the head 41(3) has a characteristic of ejecting ink with difficulty (ink ejection amount is less than an appropriate amount), the head 41(4) has a characteristic of ejecting ink normally (the ink ejection amount is appropriate), and the head 41(5) has a characteristic of ejecting ink easily (the ink ejection amount is more than an appropriate amount). For this reason, suppose that when it is necessary to form dots with an appropriate ejection amount (hereinafter referred to as medium dots), the head 41(3) forms dots with ejection amounts that are less than the appropriate amount (hereinafter referred to as small dots), the head 41(4) forms medium dots, and the head 41(5) forms dots with ejection amounts that are greater than the appropriate amount (hereinafter referred to as large dots). It should be noted that a majority of the other heads 41 of the ten heads 41 are considered to form medium dots in a same manner as the head 41(4).

Figure 5A:
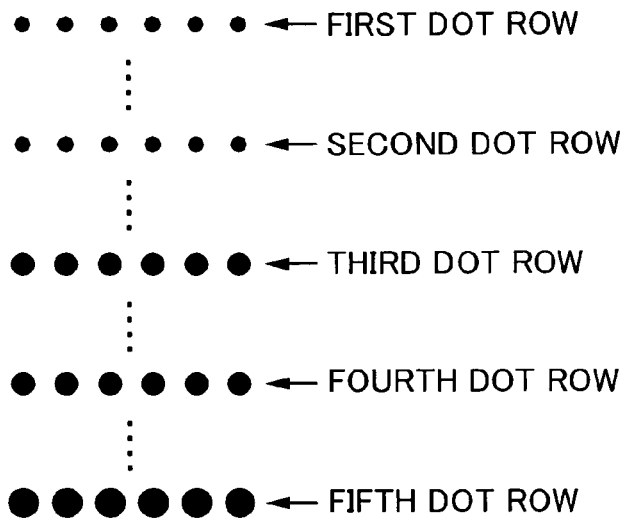
FIG. 5A and FIG. 5B are diagrams for describing density irregularities arising from ejection characteristic differences among heads 41.
Figure 5B:
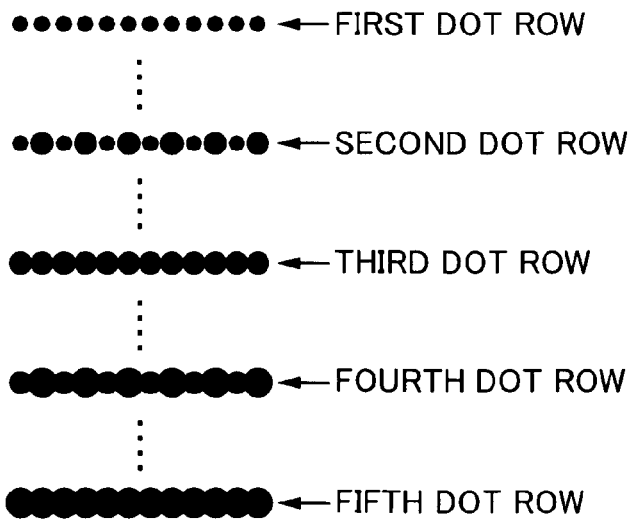

FIG. 5A and FIG. 5B are diagrams for describing density irregularities arising from ejection characteristic differences among the heads 41. The dot rows shown in FIG. 5A and FIG. 5B are formed by two passes, with FIG. 5A showing the dot rows after pass 1 and FIG. 5B showing the dot rows after pass 2.

In the first dot row of the five dot rows, pass 1 and pass 2 are performed by head 41(3). Thus, only small dots are aligned in the first dot row. In the second dot row, pass 1 is performed by head 41(3) and pass 2 by head 41(4). Thus, in the second dot row, small dots and medium dots are aligned alternately. In the third dot row, pass 1 and pass 2 are performed by head 41(4), thus only medium dots are aligned. In the fourth dot row, pass 1 is performed by head 41(4) and pass 2 by head 41(5), thus medium dots and large dots are aligned alternately. In the fifth dot row, pass 1 and pass 2 are performed by the head 41(5), thus only large dots are aligned.

In this case, the first dot row is formed by only small dots so that the first dot row appears lighter compared to dot rows formed by medium dots (dots with an appropriate ejection amount). In other words this is recognized as a density irregularity. Similarly, the fifth dot row is formed by only large dots and the fifth dot row appears darker compared to dot rows formed by medium dots. In other words, it is recognized as a density irregularity. And when the numbers of first dot rows and fifth dot rows increase, the density irregularities become apparent thereby resulting in an even greater reduction in image quality.

On the other hand, the third dot row is formed by only medium dots, and therefore it has an appropriate density. And in the second and fourth dot rows, even if there are small dots and large dots included therein, medium dots share a half to neutralize the density as a whole such that density irregularities is difficult to be recognized.

In this way, in a configuration in which a plurality of heads 41 having different ink ejection characteristics are used to form dot rows, a problem may occur in which density irregularities become apparent in the case where dot rows are formed by only a single head 41 (the above-mentioned head 41(3) and head 41(5)).

Relationship Between Total Sub-Scanning Amount of the Head Unit and Width of the Head Unit During Printing The printer 1 according to the present embodiment is configured to eject ink across the entire width of the printing tape T with the four movements in the main scanning direction (pass 1 to pass 4). Since the image resolution (for example, a sub-scanning direction resolution of 720 dpi) is smaller than the nozzle pitch (360 dpi), this is achieved by moving the head unit 40 in the sub-scanning direction by units of 720 dpi to form dot rows with intervals smaller than the nozzle pitch.

On the other hand, the head unit 40 moves three times in the sub-scanning direction (FIG. 4C, FIG. 4E, and FIG. 4G) during the four passes 1 to 4. And in order to eject ink across the entire width of the printing tape T with passes 1 through 4, the sub-scanning direction width of the head unit 40 varies in response to the amount of total movement by the three moves (hereinafter referred to as "total sub-scanning amount"). Description is given regarding this point with reference to FIG. 6A and FIG. 6B.

Figure 6A:
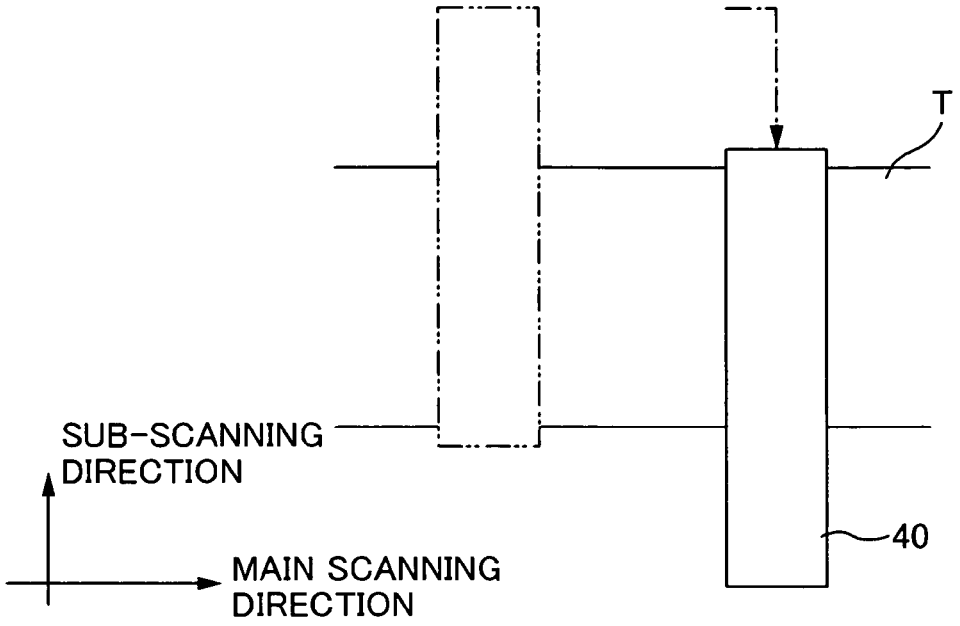
FIG. 6A is a diagram showing the head unit 40 in the case where the total amount of sub-scanning is increased.
Figure 6B:
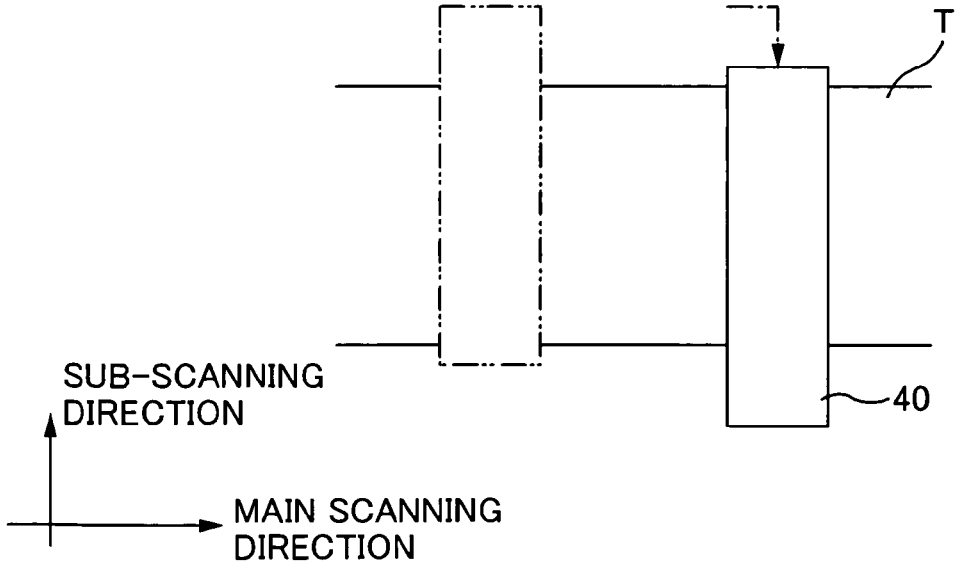
FIG. 6B is a diagram showing the head unit 40 in the case where the total amount of sub-scanning is reduced.

FIG. 6A shows the width of the head unit 40 in the case where the total sub-scanning amount is increased. FIG. 6B shows the width of the head unit 40 in the case where the total sub-scanning amount is reduced. It should be noted that the head units 40 on the left-side indicated by chained double-dashed lines in FIGS. 6A and 6B are in a state immediately prior to the first time main scanning direction movement (pass 1) and the head units 40 on the right-side indicated by solid lines are in a state immediately before the fourth time main scanning direction movement (pass 4). Thus, the amount of shift in the sub-scanning direction between the head units 40 in the chained double-dashed line and the head units 40 in the solid line is the total sub-scanning amount of the head unit 40.

As can be seen from FIG. 6A and FIG. 6B, the larger the amount of scanning is, the larger the width of the head unit 40 in the sub-scanning direction is, so that ink is ejected across the entire width of the printing tape T. That is, the number of heads 41 constituting the head unit 40 increases. And when the width of the head unit 40 increases, there is a risk that upsizing of the printer 1 will be required to secure installation space for the head unit 40.

Print Processing According to the Present Embodiment

In order to curb the above-mentioned problems, namely apparent density irregularities and increase of width in the sub-scanning direction of the head unit 40, the printer 1 executes print processing in the following description.

Aspects of this print processing include (1) the head unit 40 moved by the drive unit 30 so that the total amount of movement of the head unit 40 in the sub-scanning direction during printing is smaller than an effective nozzle width (described later) in the sub-scanning direction of a single head 41, and (2) raster line groups formed so that, of the raster line groups (a plurality of dot rows), the number of raster lines (dot rows) to be formed by ejecting ink from the nozzles of only one head 41 is not greater than the number of raster lines formed by ejecting ink from the nozzles of two or more heads 41.

The various operations of the printer 1 during print processing are mainly achieved by the controller 10. Particularly, in the present embodiment, the operations are achieved by a CPU 12 executing programs stored in a memory 13. These programs are constituted by a program code for performing various operations that are described below.

Figure 7:
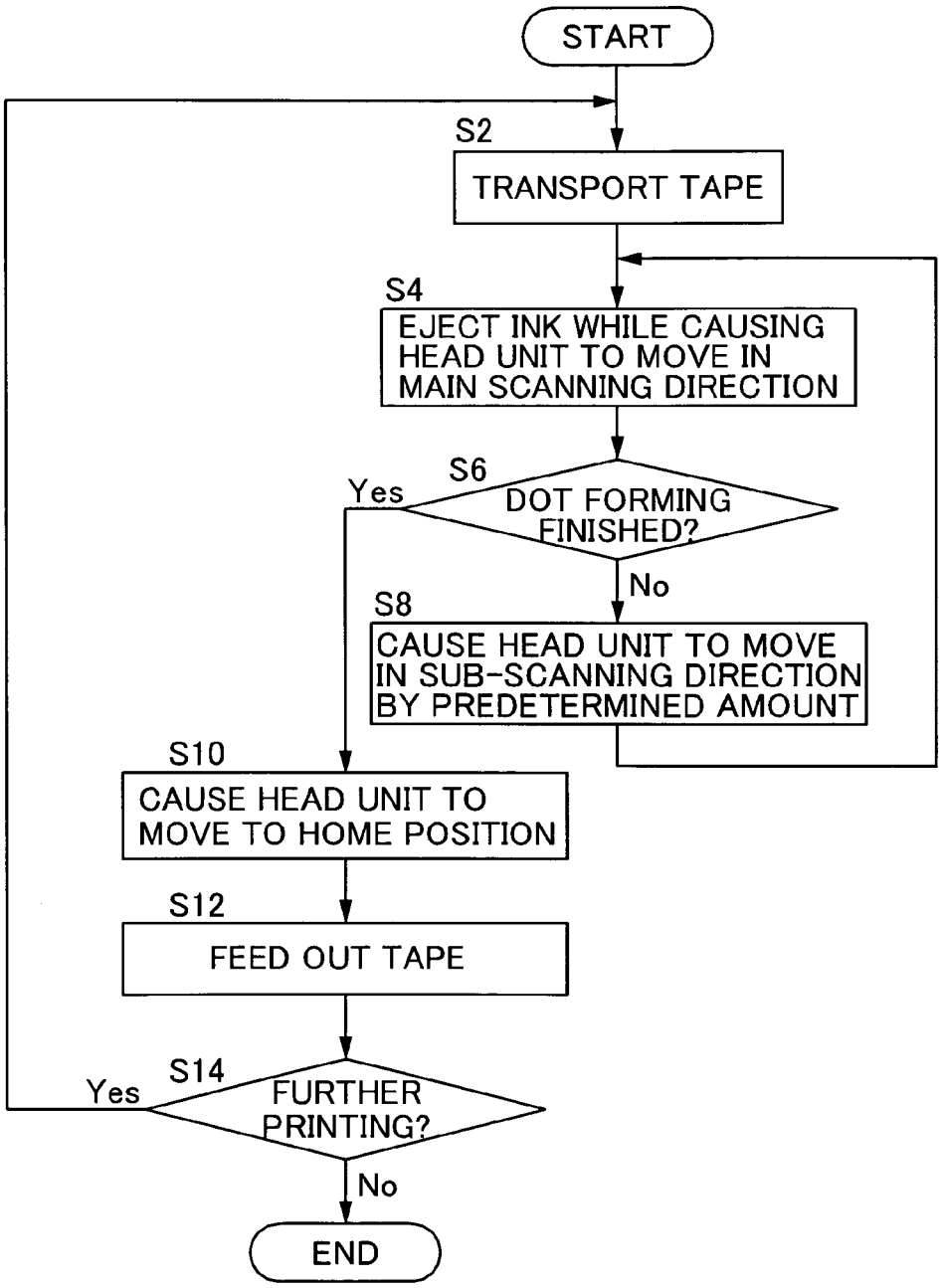
FIG. 7 is a flowchart for describing the present printing process.

FIG. 7 is a flowchart for describing the present print processing. The flowchart shown in FIG. 7 begins when the controller 10 receives print data from a computer 90 (FIG. 1) via an interface 11.

In the present print processing, the controller 10 first feeds the printing tape T into the printing region (step S2) with the transport unit 20. In other words, the feed rollers 21 feed the printing tape T before printing onto the suction table 23, which is the printing region.

Next, the controller 10 causes ink to be ejected from the nozzles while causing the drive unit 30 to move the head unit 40 (FIG. 4B) in the main scanning direction (step S4). That is, the controller 10 forms dot rows by pass 1 on the printing tape T held on the suction table 23. Since the image (print item) is formed by four passes, when the dot rows of pass 1 are formed, the controller 10 causes the drive unit 30 to move the head unit 40 in the sub-scanning direction by a certain sub-scanning amount (FIG. 4C) (step S6: no, step S8).

Then, the controller 10 alternately carries out forming of dot rows accompanied by the main scanning direction movements (FIG. 4D, FIG. 4F, and FIG. 4H) of the head unit 40, and the sub-scanning direction movements (FIG. 4E and FIG. 4G) of the head unit 40 until the dot formation process finishes (steps S4 to S8). It should be noted that a so-called overlap printing is carried out in the present embodiment.

Here, description is given on overlap printing according to the present embodiment. Overlap printing is a printing method in which a single dot row (raster line) is formed with the use of two or more nozzles. Specifically, one nozzle forms an intermittent row of dots by forming dots at several dots interval in the main scanning direction. Then, a different nozzle forms a dot row so as to complement the already-formed intermittent row of dots.

Figure 8:
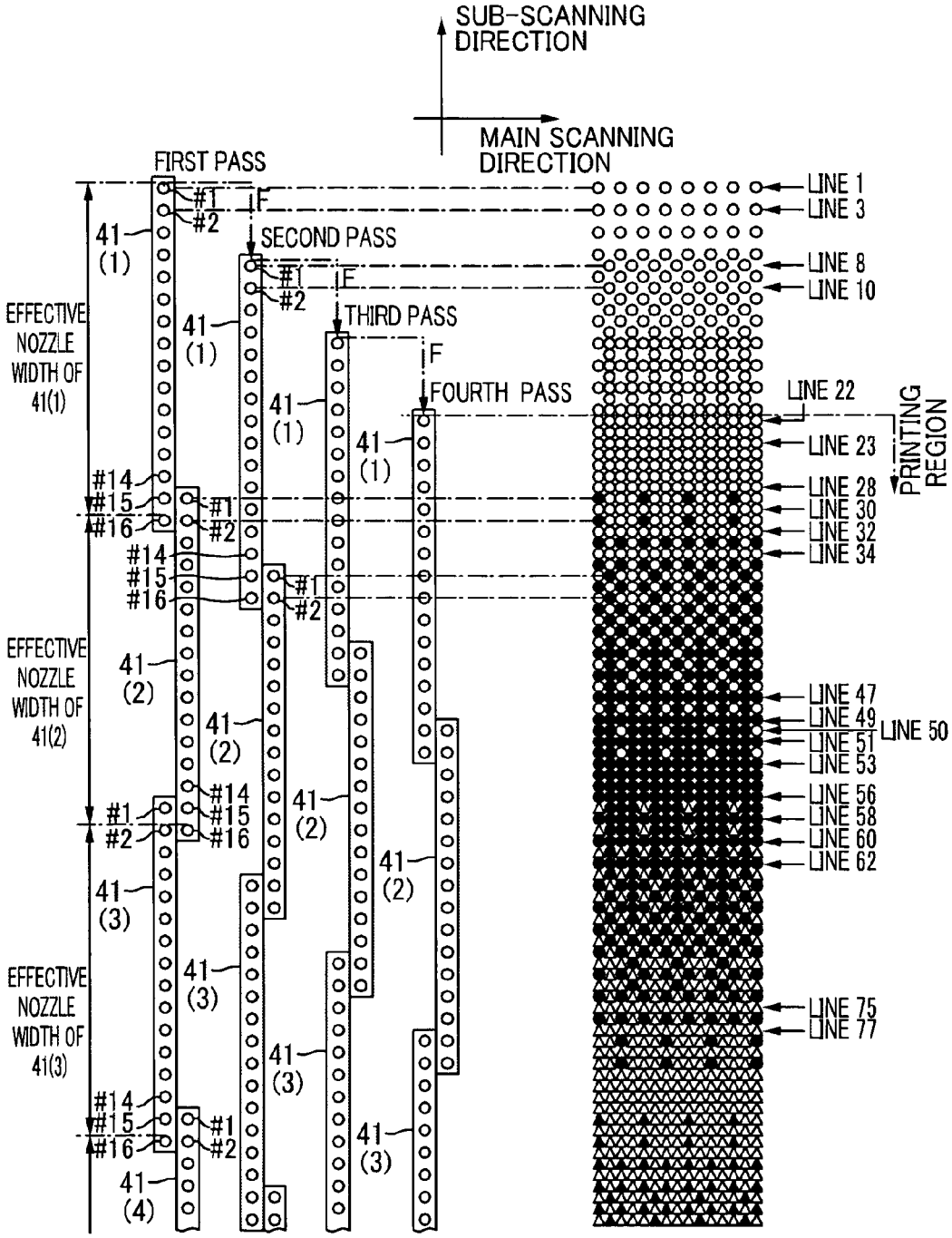
FIG. 8 is a diagram for describing overlap printing according to the present embodiment.
Figure 9:
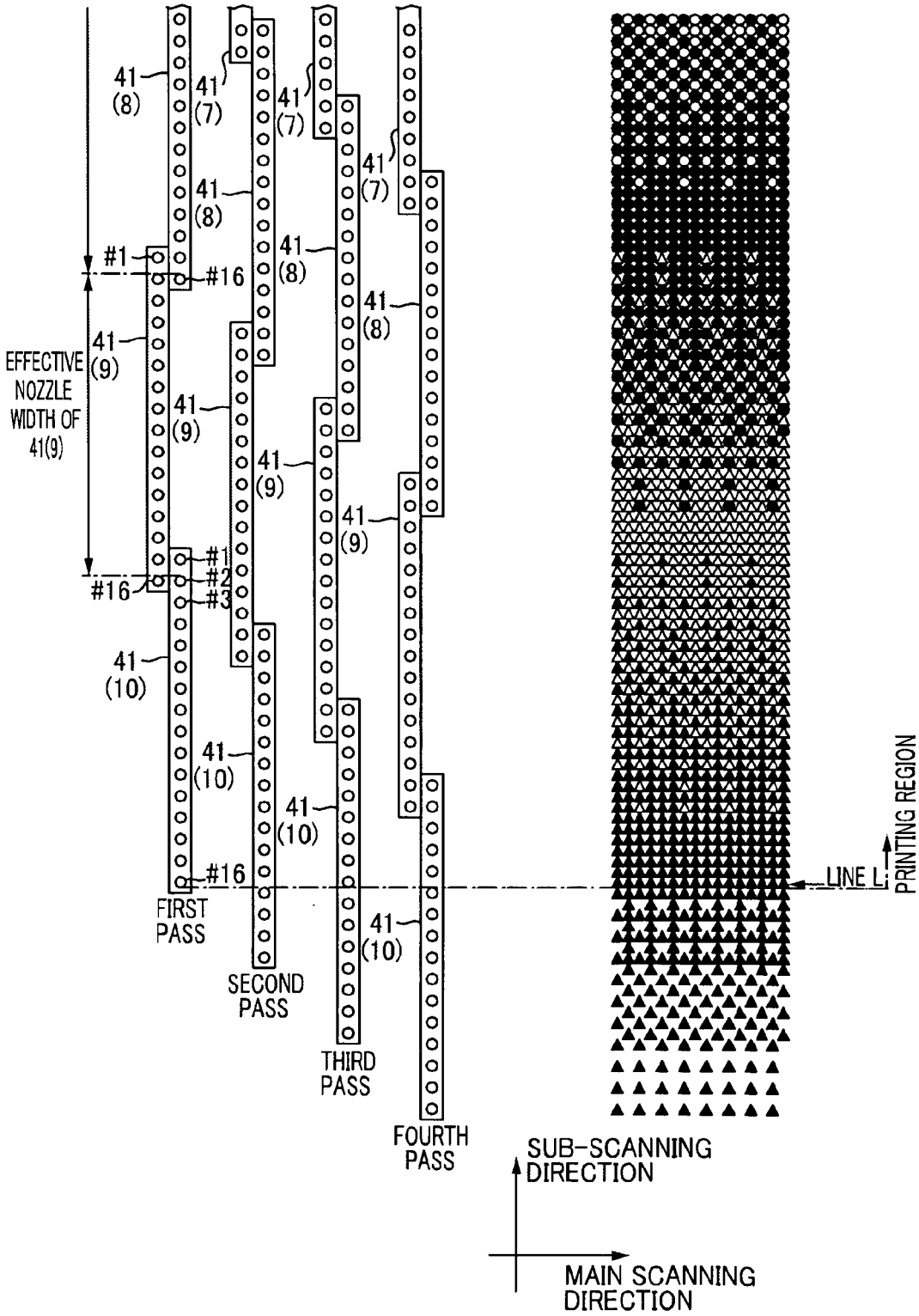
FIG. 9 is a diagram for describing overlap printing according to the present embodiment.

FIG. 8 and FIG. 9 are diagrams for describing overlap printing according to the present embodiment. However, for the sake of brevity, only nozzle row C of the four nozzle rows (nozzle row Y, nozzle row M, nozzle row C, and nozzle row K) in each of the heads 41 is shown, and the number of nozzles in each of the heads 41 is reduced to 16 nozzles. For this reason, FIG. 8 shows the position of nozzle row C of the heads (head 41(1), head 41(2) and so on) on the farther side of the ten heads 41 in the sub-scanning direction during passes 1 through 4 and how the dots are formed thereby. And FIG. 9 shows the position of nozzle row C of the heads (head 41(10), head 41(9) and so on) on the near side in the sub-scanning direction during passes 1 through 4 and how dots are formed thereby. Furthermore, in FIG. 8 and FIG. 9, the dots formed by the nozzles of head 41(1) and head 41(7) are shown as white dots (○), the dots formed by the nozzles of head 41(2) and head 41(8) are shown as black dots (●), the dots formed by the nozzles of head 41(3) and head 41(9) are shown as white triangles (Δ), and the dots formed by the nozzles of head 41(4) and head 41(10) are shown as black triangles (▲).

At passes 1 through 4, dots are formed in the pixels of the printing region by the nozzles of nozzle row C. Here, "pixels" refers to square grids that are virtually determined on the printing tape T for limiting the positions at which dots are to be formed. Further still, since an explanation is made on specific pixels, pixels lined up in the main scanning direction are expressed as "lines" and pixels lined up in the sub-scanning direction are expressed as "rows". It should be noted that the pixels shown in FIG. 8 and FIG. 9 are lined up with intervals of 720 dpi in both the main scanning direction and the sub-scanning direction.

First, in pass 1, ink is ejected from the nozzles of each of the heads 41. And dot rows are formed in the pixels of odd numbered lines (lines 1, 3, 5, and so on) and odd numbered rows (rows 1, 3, 5, and so on) as shown in FIG. 8. For example, ink is ejected from nozzle #1 of the head 41(1) to form dots in the pixels in the odd numbered rows of the first line. Similarly, ink is ejected from nozzle #2 of the head 41(1) to form dots in the pixels in the odd numbered rows of the third line. In this way, each nozzle forms dots in every other pixel in the main scanning direction at each line corresponding to their respective positions.

It should be noted that the manner in which ink is ejected from the overlapping nozzles of two adjacent heads in the width direction (here description is given using the head 41(1) and the head 41(2) as examples) is different from the manner in which ink is ejected from the nozzles that do not overlap (for example, nozzle #1 of the head 41(1)). That is, in pass 1, nozzle #15 and nozzle #16 on the back side of head 41(1) in the width direction form dot rows in the pixels of rows 3, 7, 11, and so on, and nozzle #1 and nozzle #2 of the near side of the head 41(2) form dot rows in the pixels of rows 1, 5, 9, and so on. In this way, the nozzles of two adjacent heads 41 eject ink alternately and form dot rows in pixels of the odd numbered rows.

After pass 1 ends, the head unit 40 moves by a predetermined sub-scanning amount F (specifically, 7/720 dpi) from the back side to the near side in the sub-scanning direction as a first time sub-scanning direction movement during printing.

In pass 2 after the movement of the head unit 40, dot rows are formed in pixels of even numbered lines (lines 8, 10, 12, and so on) and even numbered rows (rows 2, 4, 6, and so on). For example, ink is ejected from nozzle #1 of the head 41(1) and dots are formed in the pixels in the even numbered rows of the eighth line. Similarly, ink is ejected from nozzle #2 of the head 41(1) and dots are formed in the pixels in the even numbered rows of the tenth line. Furthermore, in pass 2, nozzle #15 and nozzle #16 on the back side of the head 41(1) of the adjacent heads in the width direction form dot rows in the pixels of rows 4, 8, 12, and so on, and nozzle #1 and nozzle #2 on the near side of the head 41(2) form dot rows in the pixels of rows 2, 6, 10, and so on. That is, in a same manner as in pass 1, the nozzles of the two adjacent heads 41 eject ink alternately and form dot rows in pixels in the even numbered rows (the same is true in regard to the third pass and the fourth pass, which are described later).

After pass 2 ends, the head unit 40 moves by a predetermined sub-scanning amount of F (7/720 dpi) as a second time sub-scanning direction movement.

Similarly, in pass 3, dot rows are formed in pixels of odd numbered lines (lines 15, 17, 19, and so on) and even numbered rows (rows 2, 4, 6, and so on). As a result, a dot row in the twenty-third line, for example, is completed by pass 1 and pass 3.

After pass 3 ends, the head unit 40 moves by a sub-scanning amount of F (7/720 dpi), which is the same amount as that of the first time and second time sub-scanning, as a third time sub-scanning direction movement. In this way, the amount of movement F in each of the three times of movement by the head unit 40 in the sub-scanning direction is of the same. Furthermore, a total of the three times of sub-scanning amounts of the head unit 40 (total sub-scanning amount 3F) has a relationship in that it is smaller than an effective nozzle width of a single head 41, which is described later.

First, description is given regarding effective nozzles. The idea of effective nozzles is different depending on whether or not there are overlapping nozzles (mentioned earlier) between adjacent heads 41. In the case where there are no overlapping nozzles, effective nozzles of heads 41 refer to all the nozzles of the nozzle rows (see FIG. 11). On the other hand, in the case where there are overlapping nozzles, the effective nozzles of the heads 41 are determined by taking the overlapping nozzles into consideration. Specifically, the effective nozzles of a head 41 are constituted by non-overlapping nozzles among nozzle rows within the head 41, and overlapping nozzles within the head 41 that are evenly distributed in relation with a different head 41.

Here, description is given regarding how the overlapping nozzles are evenly distributed. For example, in FIG. 8, nozzle #15 and nozzle #16 of the head 41(1) overlap nozzle #1 and nozzle #2 of the head 41(2). In this case, the overlapping nozzles are distributed evenly such that it is the nozzle #15 of nozzle #15 and nozzle #16 that is included in the effective nozzles of the head 41(1), and it is the nozzle #2 of nozzle #1 and nozzle #2 that is included in the effective nozzles of the head 41(2). In this way, half the nozzles of the overlapping nozzles of the head 41 are distributed to that head 41 so as to be included as effective nozzles.

Each of the ten heads 41 of the present embodiment have overlapping nozzles, and the effective nozzles of the heads 41 are as follows. The effective nozzles in the head 41(1) are the 15 nozzles being, nozzle #1 to nozzle #14, and nozzle #15 of nozzle #15 and nozzle #16 that overlap with nozzle #1 and nozzle #2 of the head 41(2). On the other hand, the effective nozzles in the head 41(2) are the 14 nozzles being, nozzle #2 of nozzle #1 and nozzle #2 that overlap with nozzle #15 and nozzle #16 of the head 41(1), nozzle #3 to nozzle #14, and nozzle #15 of nozzle #15 and nozzle #16 that overlap with nozzle #1 and nozzle #2 of the head 41(3). As in the head 41(2), the effective nozzles of the head 41(3) to head 41(9) are nozzle #2 to nozzle #15. On the other hand, the effective nozzles in the head 41(10) are the 15 nozzles being, nozzle #2 of nozzle #1 and nozzle #2 that overlap the nozzles of the head 41(9), and nozzle #3 to nozzle #16.

Next, description is given regarding the effective nozzle width, which is determined from the aforementioned effective nozzles. The effective nozzle width is the width between effective nozzles in the sub-scanning direction (the effective nozzles are lined up with an interval of 2/720 dpi in the sub-scanning direction). In the present embodiment, the effective nozzle width in the head 41(1) and the head 41(10) is 30/720 dpi since there are 15 effective nozzles. On the other hand, the effective nozzle width in the head 41(2) to the head 41(9) is 28/720 dpi since there are 14 effective nozzles. And in the printer 1, the total sub-scanning amount 3F (21/720 dpi) during printing by the head unit 40 is set to be smaller than the effective nozzle width that is smaller (28/720 dpi) of the two effective nozzle widths.

Description on overlap printing continues. In pass 4, dot rows are formed in pixels in even numbered lines (lines 22, 24, 26, and so on) and odd numbered rows (rows 1, 3, 5, and so on). As a result, a dot row of the twenty-second line, for example, is completed by pass 2 and pass 4. In this manner, in overlap printing of the present embodiment, a single dot row is formed by two different nozzles.

Here, discussion will follow on which nozzles of the heads 41 are used to form the dot rows (raster lines) of the printing region. Here, dot rows of the printing region refer to dot rows that are completed as in the dot row of the twenty-second line, and in the present embodiment refer to dot rows of line 22 to line L (FIG. 9).

First, attention is given to the 28 dot rows (raster lines) from line 22 to line 49. These dot rows are formed by the nozzles of the head 41(1) and head 41(2). Examining this in detail, the ten dot rows of lines 22 to 28, line 30, line 32, and line 34 are formed by two different nozzles of the head 41(1), and the two dot rows of lines 47 and 49 are formed only by two different nozzles of the head 41(2). On the other hand, of the 28 dot rows, the dot rows (16 dot rows) other than those mentioned above are formed by nozzles of both the head 41(1) and the head 41(2). In this way, in the dot rows of lines 22 to 49, the number of dot rows (12 rows) formed by nozzles of only a single head 41 is less than the number of dot rows (16 rows) formed with nozzles of two heads 41.

Next, attention is given to the 28 dot rows from line 50 to line 77. It should be noted that the reason for giving attention to every 28 dot rows is because dot rows of the printing region are formed by repeating, as a single cycle, the 28 dots rows according to the sub-scanning amount F (7/720 dpi) of the head unit 40 being a quarter of the effective nozzle width (28/720 dpi), (in other words, a combination of nozzles forming each dot row are determined for each 28 dot rows). That is, in a same manner as the 28 dot rows of lines 50 to 77, the following 28 dot rows (for example, dot rows of lines 78 to 105) are also formed in a same manner as the 28 dot rows of lines 22 to 49.

And the dot rows of lines 50 to 77 are formed by the nozzles of the head 41(1), head 41(2), and head 41(3). Examining this in detail, the eight dot rows of line 51, line 53 to line 56, line 58, line 60, and line 62 are formed by two different nozzles of the head 41(2), and the two dot rows of line 75 and line 77 are formed by two different nozzles of the head 41(3). On the other hand, the dot rows (18 dot rows) of the 28 dot rows other than those mentioned above are formed by nozzles of two heads among the head 41(1), head 41(2), and head 41(3).

In this way, even in the case of the dot rows of lines 50 to 77 (that is, the 28 dot rows corresponding to a single cycle in the case where the combination of nozzles used are repeated cyclically), the number of dot rows (10 rows) formed by nozzles of only a single head 41 is less than the number of dot rows (18 rows) formed by nozzles of two heads 41. And in the present print processing, of the dot rows included in the printing region, the number of dot rows formed by nozzles of only a single head 41 is less than the number of dot rows formed by nozzles of two heads 41.

Description was given above concerning overlap printing according to the present embodiment. Returning to the flowchart shown in FIG. 7, description on the present print processing will continue. When dot formation processing is completed by forming the dot rows in pass 4 (step S6: yes) or in other words, when the item to be printed (image) is printed on the printing tape T, the controller 10 causes the drive unit 30 to move the head unit 40 in the sub-scanning direction (FIG. 4I) so as to be positioned at the home position (step S10).

Next, the controller 10 uses the transport unit 20 to feed out from the printing region the printing tape T on which dots have been formed (printed printing tape T) (step S12). That is, the feed out rollers 22 feed out the printed printing tape T from the printing region.

In the case where there is further print data to be printed (step S14: yes), the controller 10 repeats the above-described operation (steps S2 to S12) to carry out printing on the printing tape T. On the other hand, in the case where there in no more print data (step S14: no), the controller 10 finishes the present print processing.

Effectiveness of the Present Print Processing

In the above-described print processing, the controller 10 causes the head unit 40 to move in a way that the total sub-scanning amount 3F (21/720 dpi) in the sub-scanning direction of the head unit 40 is smaller than the effective nozzle width (28/720 dpi) in the sub-scanning direction of a single head 41, thereby enabling to control the width of the head unit 40 in the sub-scanning direction from increasing.

That is, as described above, the larger the total sub-scanning amount of the head unit 40 is, the wider the width of the head unit 40 in the sub-scanning direction becomes (see FIG. 6). Therefore, by making the total sub-scanning amount of the head unit 40 smaller than the effective nozzle width of a single head 41, overlap printing can be achieved while reducing the total sub-scanning amount of the head unit 40 (FIG. 8, FIG. 9). And as a result, increase in the width of the head unit 40 (increase in the number of heads 41) can be controlled even in the case where ink is ejected across the entire width of the printing tape T by each of the passes in overlap printing.

Furthermore, deterioration in image quality can be controlled by forming raster line groups with the controller 10 so that, of the raster line groups (the raster lines within the printing region in FIG. 8 and FIG. 9), the number of raster lines formed by ejecting ink from the nozzles of only a single head 41 is not greater than the number of raster lines formed by ejecting ink from the nozzles of two or more heads 41.

That is, as described above, density irregularities tend to become more apparent (see FIG. 5) with an increase in the number of raster lines formed by the nozzles of only a single head 41 (the head 41(3) having a small ejection amount or the head 41(5) having a large ejection amount, as described in FIG. 5). Hence, by keeping the number of raster lines formed by the nozzles of only a single head 41 equal or less than the number of raster lines formed by the nozzles of two or more heads 41, the proportion of raster lines (raster lines causing density irregularities) formed by nozzles of only a single head 41 (which of the ten heads 41 are heads 41 having a small ejection amount or heads 41 having a large ejection amount) can be reduced (FIG. 8, FIG. 9). For this reason, density irregularities can be kept from becoming apparent and, as a result, deterioration in image quality can be curbed.

It should be noted that by keeping the total sub-scanning amount 3F smaller than the effective nozzle width of a single head 41, density irregularities arising from linkages between adjacent heads 41 can be controlled from becoming apparent. That is, since head unit 40 is a component in which ten heads 41 are linked in the sub-scanning direction, it is known that density irregularities may occur when the positional accuracy of the linkages is poor. And in the case where an image is formed by a plurality of passes, when the linkages in pass 1 and the linkages in pass 2 overlap in the sub-scanning direction for example, density irregularities arising from the linkages become apparent. In contrast, by keeping the total sub-scanning amount 3F smaller than the effective nozzle width of a single head 41 as in the present print processing, density irregularities can be kept from becoming apparent owing to the linkages between the heads in passes 1 to 4 being scattered as shown in FIG. 8 and FIG. 9.

Consequently, with the above-described print processing, the width of the head unit 40 in the sub-scanning direction can be controlled from increasing and deterioration in image quality can be curbed as well.

Furthermore, in the above-described print processing, the controller 10 causes ink to be ejected from all the heads 41 in the four passes of passes 1 to 4 (corresponding to m number movements). In this way, the total sub-scanning amount by the head unit 40 can be reduced while achieving overlap printing with a minimum number of heads 41.

Further still, in the above-described print processing, the controller 10 controls the three movements in the sub-scanning direction by the head unit 40 (corresponding to n times of movement) so that each amount of movement are the same. Therefore, the dot rows are formed cyclically and the position where the density irregularities occur are made to be scattered systematically, thereby enabling to curb density irregularities from becoming apparent in an effective manner.

Second Embodiment

Figure 10:
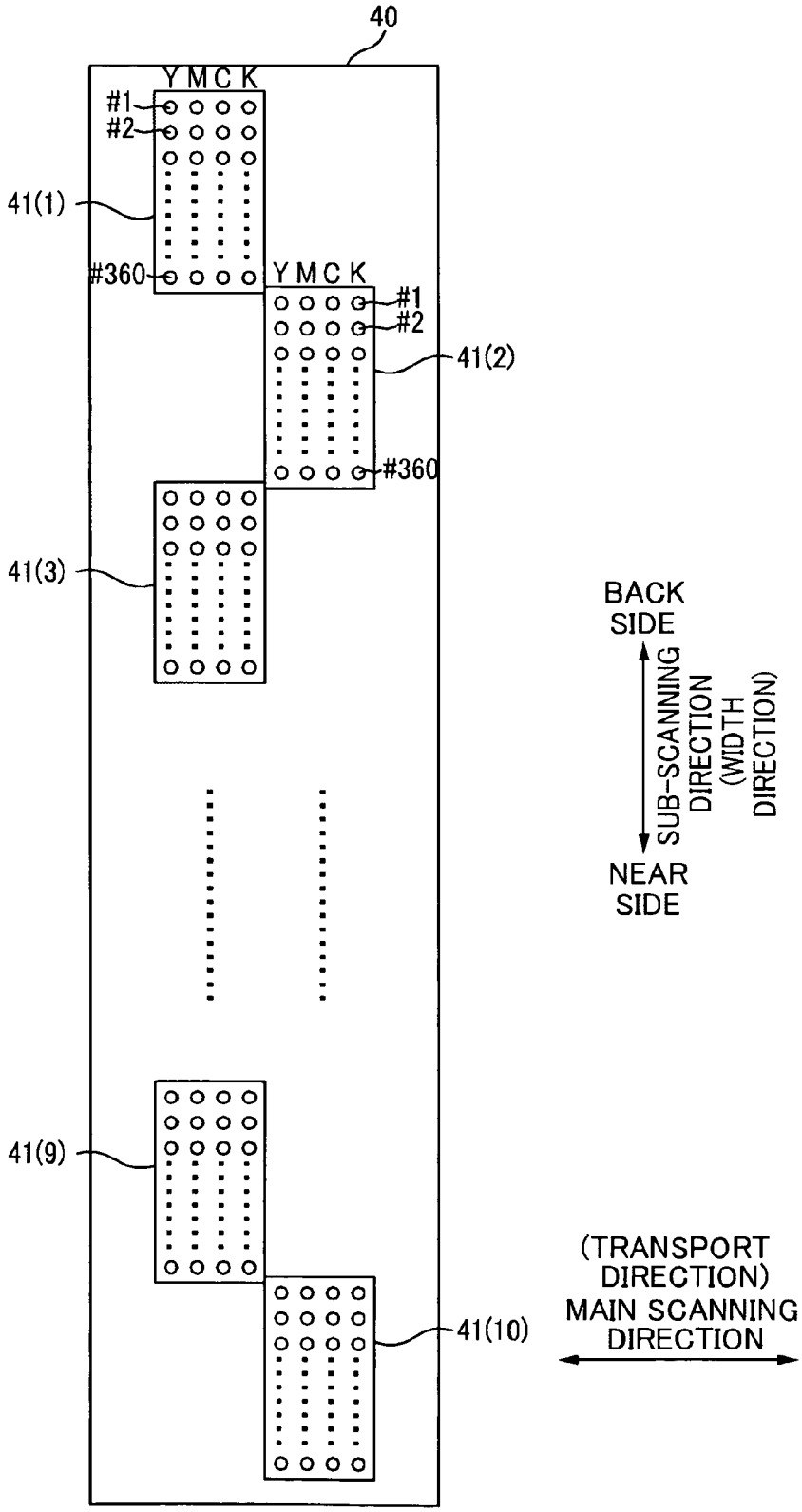
FIG. 10 is a diagram showing a head unit 40 according to a second embodiment.

FIG. 10 shows a head unit 40 according to a second embodiment. Unlike the head unit 40 according to the first embodiment shown in FIG. 3, this head unit 40 does not have overlapping nozzles. It should be noted that other than this, the configuration of the second embodiment is equivalent to that of the first embodiment and therefore description thereof is omitted.

In the second embodiment too, the controller 10 (1) causes the drive unit 30 to move the head unit 40 so that the total movement amount of the head unit 40 in the sub-scanning direction during printing is less than the effective nozzle width in the sub-scanning direction of a single head 41, and (2) forms raster line groups so that, of the raster line groups, the number of raster lines formed by ejecting ink from the nozzles of only a single head 41 is not greater than the number of raster lines formed by ejecting ink from the nozzles of two or more heads 41.

Figure 11:
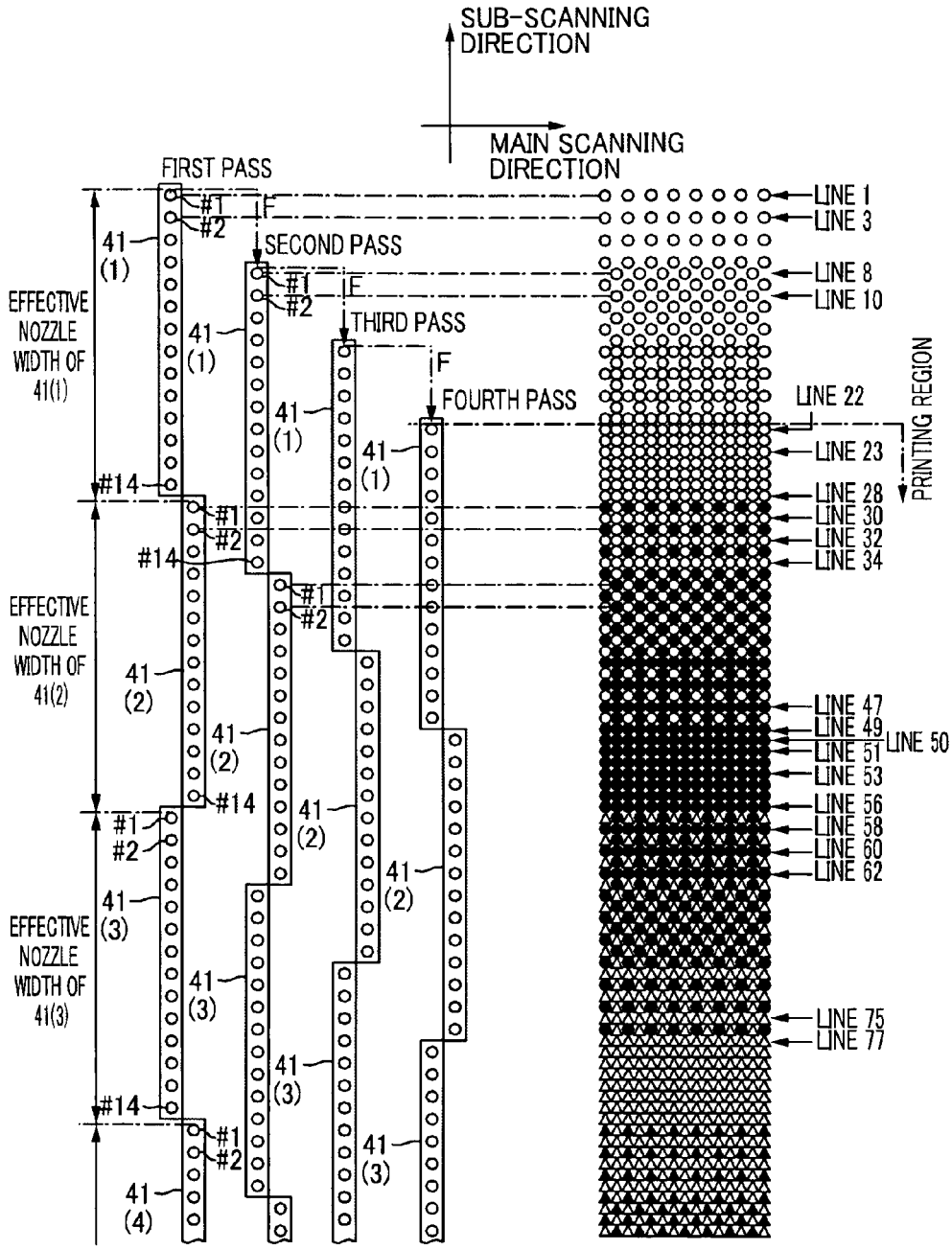
FIG. 11 is a diagram for describing overlap printing according to the second embodiment.

FIG. 11 is a diagram for describing overlap printing according to the second embodiment. As in FIG. 8, only nozzle row C is shown in FIG. 11 and the number of nozzles in each head 41 is also 14. And dots formed by the nozzles of the head 41(1) are shown as white dots (○), the dots formed by the nozzles of the head 41(2) are shown as black dots (●), the dots formed by the nozzles of the head 41(3) are shown as white triangles (Δ), and the dots formed by the nozzles of the head 41(4) are shown as black triangles (▲). And the effective nozzles of each of the heads 41 shown in FIG. 11 are the 14 nozzles being nozzle #1 to nozzle #14 respectively, and the effective nozzle width in each head 41 is equivalent being 28/720 dpi.

As shown in FIG. 11, a one time sub-scanning amount F of the head unit 40 is 7/720 dpi, which is the same as that in the first embodiment (FIG. 8), and the total sub-scanning amount 3F is 21/720 dpi. Thus, the total sub-scanning amount 3F (21/720 dpi) is smaller than the effective nozzle width (28/720 dpi). Therefore, the width of the head unit 40 in the sub-scanning direction can be controlled from increasing in the same manner as that in the first embodiment.

It should be noted that, in FIG. 11 the number of raster lines formed by ejecting ink from the nozzles of only a single head 41 is equivalent to the number of raster lines formed by ejecting ink from the nozzles of two or more heads 41. This is because there are no overlapping nozzles in the second embodiment, which is different from FIG. 8.

First, attention is given to the 28 dot rows in line 22 to line 49. The ten dot rows of line 22 to line 28, line 30, line 32, and line 34 are formed by the nozzles of only the head 41(1), and the four dot rows of line 43, line 45, line 47, and line 49 are formed by the nozzles of only the head 41(2). That is, there are 14 dot rows formed by the nozzles of only a single head 41. On the other hand, the dot rows (14 dot rows) of the 28 dot rows other than those mentioned above are formed by nozzles of both the head 41(1) and the head 41(2). Similarly, in the 28 dot rows of lines 50 to 77, the number of dot rows formed by only a single head 41 is 14 and the number of dot rows formed by two heads 41 is 14.

In this way, by forming raster line groups so that the number of raster lines formed by ejecting ink from the nozzles of only a single head 41 is equal or less than the number of raster lines formed by ejecting ink from the nozzles of two or more heads 41, the proportion of raster lines in the raster line groups formed by nozzles of only a single head 41 (which are heads 41 having a small ejection amount or heads 41 having a large ejection amount, as described in FIG. 5) can be reduced in a same manner as the first embodiment. For this reason, even in a case where there are raster lines formed by nozzles of only a single head 41, the number of raster lines causing density irregularities can be reduced, and as a result, density irregularities can be curbed from becoming apparent.

Third Embodiment

Figure 12:
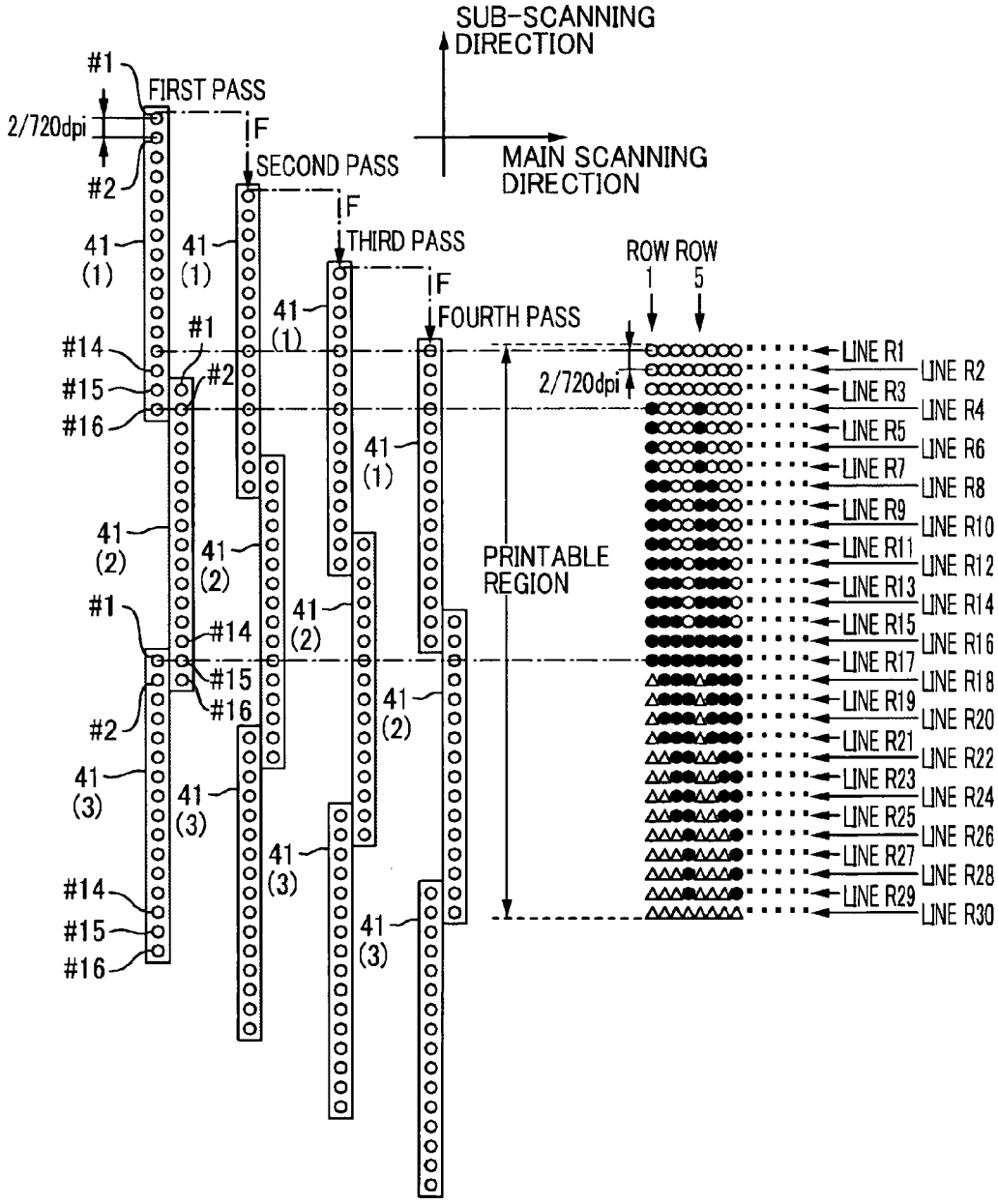
FIG. 12 is a diagram for describing overlap printing according to a third embodiment.

Next, description is given regarding overlap printing according to a third embodiment. FIG. 12 is a diagram for describing overlap printing according to the third embodiment.

In the third embodiment too, a single raster line is completed by four passes (overlap printing) as shown in FIG. 12. That is, ink is ejected from the heads during the four passes to complete a single raster line. Specifically, dots of the first row and the fifth row are formed by pass 1, dots of the second row and the sixth row are formed by pass 2, dots of the third row and the sixth row are formed by pass 3, and dots of the fourth row and the eighth row are formed by pass 4. It should be noted that in FIG. 12, dots up to the eighth row are shown, but actually dots are formed in more rows.

It should be noted that the head unit 40 in the present embodiment is equivalent to the head unit 40 of the first embodiment (FIG. 3). That is, there are overlapping nozzles in two adjacent heads 41. And the nozzle pitch between the nozzles is 1/360 dpi.

Incidentally, in contrast to the spacing of the raster lines in the first and second embodiments of 1/720 dpi (see FIG. 8 and FIG. 11), the spacing of the raster lines shown in FIG. 12 is 2/720 dpi (=1/360 dpi), (namely, the same as the nozzle pitch). Thus, unlike the first and second embodiments, in the third embodiment, interlaced printing is not carried out. Here, as shown in FIG. 8 and FIG. 11, interlaced printing refers to a print mode in which there is a non-formed raster line between a pair of raster lines formed by a single pass.

Furthermore, as in FIG. 8, only nozzle row C is shown and the number of nozzles in each head 41 is also 16 in FIG. 12. It should be noted that for the sake of convenience, description is given here assuming that the head unit 40 has three heads, the head 41(1) to head 41(3). And dots formed by the nozzles of head 41(1) are shown as white dots (○), the dots formed by the nozzles of head 41(2) are shown as black dots (●), and the dots formed by the nozzles of head 41(3) are shown as white triangles (Δ).

Furthermore, similar to the first embodiment, the effective nozzles of the heads 41 shown in FIG. 12 are as follows. The effective nozzles of the head 41(1) are the 15 nozzles of nozzle #1 to nozzle #15, and the effective nozzle width thereof is 30/720 dpi. The effective nozzles of the head 41(2) are the 14 nozzles of nozzle #2 to nozzle #15, and the effective nozzle width thereof is 28/720 dpi. The effective nozzles of the head 41(3) are the 15 nozzles of nozzle #2 to nozzle #16. The effective nozzle width thereof is 30/720 dpi.

Furthermore, in the third embodiment, a one time sub-scanning amount F of the head unit 40 is 8/720 dpi, and the total sub-scanning amount 3F of the four passes is 24/720 dpi. And in the third embodiment too, the total sub-scanning amount 3F (24/720 dpi) is set to be smaller than the effective nozzle width that is smaller (28/720 dpi) of the two effective nozzle widths. For this reason, an increase in the width of the head unit 40 in the sub-scanning direction can be controlled in a same manner as that in the first embodiment.

Here, discussion will follow on which nozzles of the heads 41 are used to form the raster lines of the printing region. Here, the raster lines of the printing region in the present embodiment are indicated as the raster lines from line R1 to R30, as shown in FIG. 12.

First, the raster lines of lines R1 to R3 are formed only by the nozzles of the head 41(1). The raster lines of lines R4 to R15 are formed by the nozzles of the head 41(1) and head 41(2). The raster lines of lines R16 and R17 are formed only by the nozzles of the head 41(2). The raster lines of lines R18 to R29 are formed by the nozzles of the head 41(2) and head 41(3). And the raster line of line R30 is formed only by the nozzles of the head 41(3).

Further still, taking a look at the range of the aforementioned effective nozzle width (28/720 dpi) (here description is given using the raster lines of lines R4 to R27 as an example), the number of raster lines formed by ejecting ink from the nozzles of only a single head 41 is the 12 raster lines from line R4 to R15, and the number of raster lines formed by ejecting ink from nozzles of two heads 41 is the two raster lines of lines R16 and R17.

In this way, the number of raster lines formed by ejecting ink from the nozzles of only a single head 41 is less than the number of raster lines formed by ejecting ink from the nozzles of two or more heads 41. In this way, in a manner similar to the first embodiment, even in a case where there is a raster line formed by nozzles of only a single head 41, the number of raster lines causing density irregularities can be reduced, and as a result, density irregularities can be curbed from becoming apparent.

It should be noted that in the foregoing description, each sub-scanning amount F of the four passes was set to be the same at 8/720 dpi, but the sub-scanning amount may be varied each time. Furthermore, in the foregoing description, dots of the first row (fifth row) are formed by pass 1, dots of the second row (sixth row) are formed by pass 2, dots of the third row (seventh row) are formed by pass 3, and dots of the fourth row (eighth row) are formed in the pass 4. But there is no limitation to this as long as the dots of the adjacent rows are formed by different passes.

Further still, in the foregoing description, a single raster line is formed by four passes. But there is no limitation to this as long as the single raster line is formed by at least two passes (two or more integer number of passes), for example a single raster line may be formed by three passes (the same is true for the first embodiment and the second embodiment).

Other Embodiments

A liquid ejecting apparatus or the like according to the invention has been described above, based on the embodiments, but the foregoing embodiments of the invention are for the purpose of elucidating the invention and are not to be interpreted as limiting the invention. The invention can of course be altered and improved without departing from the gist thereof and equivalents are intended to be embraced therein.

Furthermore, in the foregoing embodiments, the liquid ejecting apparatus was realized in an inkjet printer, but there is no limitation to this, and it can also be realized in a liquid ejecting apparatus that ejects (discharges) different liquids other than ink (for example, liquid substances in which particles of functional materials are dispersed, and fluid substances such as gels). To be specific, a liquid ejecting apparatus that ejects a liquid substance containing a dispersed or dissolved material such as an electrode material or coloring material or the like used in manufacturing or the like of liquid crystal displays, color filters, EL (electroluminescence) displays, and surface-emitting optical displays, a liquid ejecting apparatus that ejects a bioorganic substance used in manufacturing biochips, and a liquid ejecting apparatus that ejects a liquid used as a precision pipette for a specimen, for example, can be used. Further still, a liquid ejecting apparatus that performs pinpoint ejection of a lubricant to precision machinery such as watches and cameras and the like, a liquid ejecting apparatus that ejects a transparent resin liquid such as an ultraviolet curing resin or the like onto a substrate in order to form a minute hemispherical lens (optical lens) or the like used in optical communications devices or the like, a liquid ejecting apparatus that ejects an etching liquid such as an acid or an alkali in order to perform etching on a substrate or the like, and a fluid ejecting apparatus that ejects a gel can be used. The invention can be applied to an ejecting apparatus of any type among these.

Furthermore, in the foregoing embodiments, the raster lines were formed by moving the head unit 40 four times in the main scanning direction and three times in the sub-scanning direction while the printing tape T was kept stationary (FIG. 8 and FIG. 9), but there is no limitation to this. For example, the raster lines may be formed by moving the head unit 41 only in the main scanning direction and moving the printing tape T in the sub-scanning direction or the raster lines may be formed by moving the printing tape T in the main scanning direction and the sub-scanning direction while the head unit 41 stays still. That is, raster lines may be formed by moving the head unit 40 relative to the printing tape T in the main scanning direction and the sub-scanning direction.

Furthermore, in the foregoing embodiments, overlapping nozzles of adjacent heads 41 (for example, nozzle #15 of the head 41(3) and nozzle #1 of the head 41(4)) ejected ink alternately to form a single raster line (that is, ink is ejected from both of the two nozzles that overlap), but there is no limitation to this.

For example, ink may be ejected from only one of the overlapping nozzles of the adjacent heads 41. Specifically, in regard to the head 41(3), of the overlapping nozzles (nozzles #1, #2, #15, and #16), there may be a case where ink is ejected from the nozzles #1 and #2 and ink is not ejected from the nozzles #15 and #16. Similarly, in regard to the head 41(4) too, of the overlapping nozzles (nozzles #1, #2, #15, and #16), there may be a case where ink is ejected from the nozzles #1 and #2 and ink is not ejected from the nozzles #15 and #16. In this case, the number of effective nozzles (14 nozzles) in each of the heads 41 is the same.

Furthermore, in the above-described case, usage conditions are the same for nozzles at linkages between the adjacent heads 41 (mainly the overlapping nozzles) and therefore the raster lines corresponding to the linkage areas of the heads 41 are also formed equally spaced (that is, formed regularly), thereby controlling density irregularities arising at linkages.

What is claimed is:

1. A liquid ejecting apparatus comprising:

a head unit that has a plurality of heads along a first direction, in which a plurality of nozzles that eject a liquid onto a medium are lined up in the first direction, and that ejects the liquid while moving relative to the medium in a second direction, which intersects the first direction, the head unit having a width in the first direction that is greater than a width of the medium in the first direction, a movement mechanism that makes the head unit move relative to the medium a plurality of times alternately in the second direction and the first direction, and a control section that forms a raster line group by forming each raster line by making two or more different nozzles that are different eject the liquid, respectively while making the movement mechanism move the head unit relative to the medium a plurality of times alternately in the second direction and the first direction, makes the movement mechanism move the head unit relatively so that a total amount of movement of the head unit in the first direction when the head unit has moved relatively the plurality of times is less than an effective nozzle width of one of the heads in the first direction, and forms the raster line group so that a number of the raster lines formed by making the nozzles of only one of the heads eject the liquid is not greater than a number of the raster lines formed by making the nozzles of two or more of the heads eject the liquid.

2. A liquid ejecting apparatus according to claim 1, wherein in a case where a number of movements by the head unit in the second direction when the head unit moves relatively the plurality of times is set to an m number of times, all the heads eject the liquid during each movement in the second direction.

3. A liquid ejecting apparatus according to claim 1, wherein in a case where a number of movements by the head unit in the first direction when the head unit moves relatively the plurality of times is set to an n number of times, each amount of movement in the first direction is a same.

4. A raster line forming method comprising:

preparing a head unit that has a plurality of heads along a first direction, in which a plurality of nozzles that eject a liquid onto a medium are lined up in the first direction, and that ejects the liquid while moving relative to the medium in a second direction, which intersects the first direction, a width of the head unit in the first direction being greater than a width of the medium in the first direction, and forming a raster line group by forming each raster line by making two or more of the nozzles that are different eject the liquid, respectively while making the head unit move relatively with respect to the medium a plurality of times alternately in the second direction and the first direction, the head unit made to move relatively so that a total amount of movement of the head unit in the first direction when the head unit has moved relatively the plurality of times is less than an effective nozzle width of one of the heads in the first direction, and the raster line group formed so that a number of the raster lines formed by making the nozzles of only one of the heads eject the liquid is not greater than a number of the raster lines formed by making the nozzles of two or more of the heads eject the liquid.

* * * * *